US008763498B2

(12) United States Patent
Hsieh

(10) Patent No.: US 8,763,498 B2
(45) Date of Patent: Jul. 1, 2014

(54) RATCHET WRENCH

(75) Inventor: Chih-Ching Hsieh, Taichung (TW)

(73) Assignee: Kabo Tool Company, Taichung (TW)

( * ) Notice: Subject to any disclaimer, the term of this patent is extended or adjusted under 35 U.S.C. 154(b) by 378 days.

(21) Appl. No.: 13/116,009

(22) Filed: May 26, 2011

(65) Prior Publication Data

US 2012/0031240 A1 Feb. 9, 2012

(30) Foreign Application Priority Data

Aug. 3, 2010 (TW) ..... 99125765 A

(51) Int. Cl.
*B25B 13/46* (2006.01)

(52) U.S. Cl.
USPC ..... 81/63.2; 192/43.2

(58) Field of Classification Search
USPC ..... 81/63, 63.2; 192/43.2
See application file for complete search history.

(56) References Cited

U.S. PATENT DOCUMENTS

| | | | | | |
|---|---|---|---|---|---|
| 2,957,377 | A * | 10/1960 | Hare | ..... | 81/63.2 |
| 3,265,171 | A * | 8/1966 | Kilness | ..... | 192/43.2 |
| 6,282,991 | B1 * | 9/2001 | Hu | ..... | 81/63.2 |
| 6,516,692 | B1 * | 2/2003 | Hsien | ..... | 81/63.2 |
| 6,715,382 | B1 * | 4/2004 | Hsien | ..... | 81/63.2 |
| 6,732,614 | B2 * | 5/2004 | Hu | ..... | 81/63.2 |
| 6,925,913 | B2 * | 8/2005 | Chen | ..... | 81/63.2 |

* cited by examiner

*Primary Examiner* — Hadi Shakeri
(74) *Attorney, Agent, or Firm* — CKC & Partners Co., Ltd.

(57) ABSTRACT

A ratchet wrench including a holding portion, a neck portion, a switching member, a controlling rod, a blocking member, and a ratchet driving head is disclosed. The neck portion which is located at the top end of the holding portion has a cavity. The cavity has a first recess and an opening. The first recess is used for receiving a compressible elastic member and a ball. The opening is used for receiving and tightly fitting with a bendable elastic member. The switching member has a second recess to hold the bottom of the bendable elastic member, and the switching member has two adjacent arc grooves at its bottom. The controlling rod links the switching member to shift the switching member in the cavity to allow the ball to be pressed into one of the arc grooves. The controlling rod can be applied to shift, rotate or both shift and rotate the switching member in the cavity.

5 Claims, 5 Drawing Sheets

RATCHET WRENCH

RELATED APPLICATIONS

This application claims priority to Taiwan Patent Application Serial Number 99125765, filed on Aug. 3, 2010. The entire disclosure of the application is hereby incorporated by reference herein.

BACKGROUND

1. Technical Field

The present disclosure relates to wrench. More particularly, the present disclosure relates to a ratchet wrench.

2. Description of Related Art

A ratchet wrench is a matured and widely used tool. In consideration of the structure, various ratchet structures and ratchet driving heads have been provided. However, people skilled in the art still dedicate in developing new ratchet structures.

SUMMARY

Hence, an aspect of the disclosure is to provide a ratchet wrench that has a delicate ratchet structure for setting the operating direction of the ratchet driving head.

According to one embodiment of the disclosure, a ratchet wrench including a holding portion, a neck portion, a switching member, a controlling rod, a blocking member, and a ratchet driving head is disclosed. The holding portion has a top end and a bottom end. The neck portion has a cavity, and the neck portion is located at the top end of the holding portion. The cavity has a first recess located at its bottom and an opening located at its top. The first recess is used for receiving a compressible elastic member and a ball in sequence, and the opening is used for receiving and tightly fitting with a bendable elastic member, such as spring. The switching member is installed inside the cavity and has a second recess at its top to hold the bottom of the bendable elastic member, and also has two adjacent arc grooves at its bottom. The controlling rod is partially extended to the surface of the neck portion, and the controlling rod links the switching member to shift the switching member in the cavity and thus to allow the ball to be pressed into one of the arc grooves by the compressible elastic member, thereby fixing the switching member at a predetermined angle and bending the bendable elastic member toward one side of the holding portion. Additionally, the blocking member is located above the cavity. The blocking member has a cave at its bottom to hold the top of the bendable elastic member, and thus the blocking member is pressed by the bendable elastic member to rotate itself. The blocking member has an arc shaped concave surface and a first teeth structure, wherein the arc shaped concave surface is located at the top of the blocking member, and the first teeth structure is disposed at the arc shaped concave surface. The ratchet driving head is located above the blocking member. The ratchet driving head has an accommodation space to install a ratchet, and the ratchet has a second teeth structure disposed at its outer surface corresponding to the first teeth structure of the blocking member.

Accordingly, when being bent, the bendable elastic member resists the cave of the blocking member to shift the blocking member, and thus the first teeth structure engages one side of the second teeth structure to control the operating direction of the ratchet driving head. It is worthy to be noted that the controlling rod can be applied to shift, rotate or both shift and rotate the switching member in the cavity.

According to another embodiment of the disclosure, a ratchet wrench having similar structure with that described above is disclosed, except that the first recess of the cavity and the nearby arc grooves of the switching member described above are exchanged respectively. Meanwhile, the controlling rod is applied to rotate the switching member inside the cavity. On the other hand, the compressible elastic member and the bendable elastic are both can be formed by respective springs.

Therefore, the ratchet wrenches of the embodiments achieve the function that slightly moving the controlling rod to change the operating direction of the ratchet driving head.

DETAILED DESCRIPTION

Figure 1:
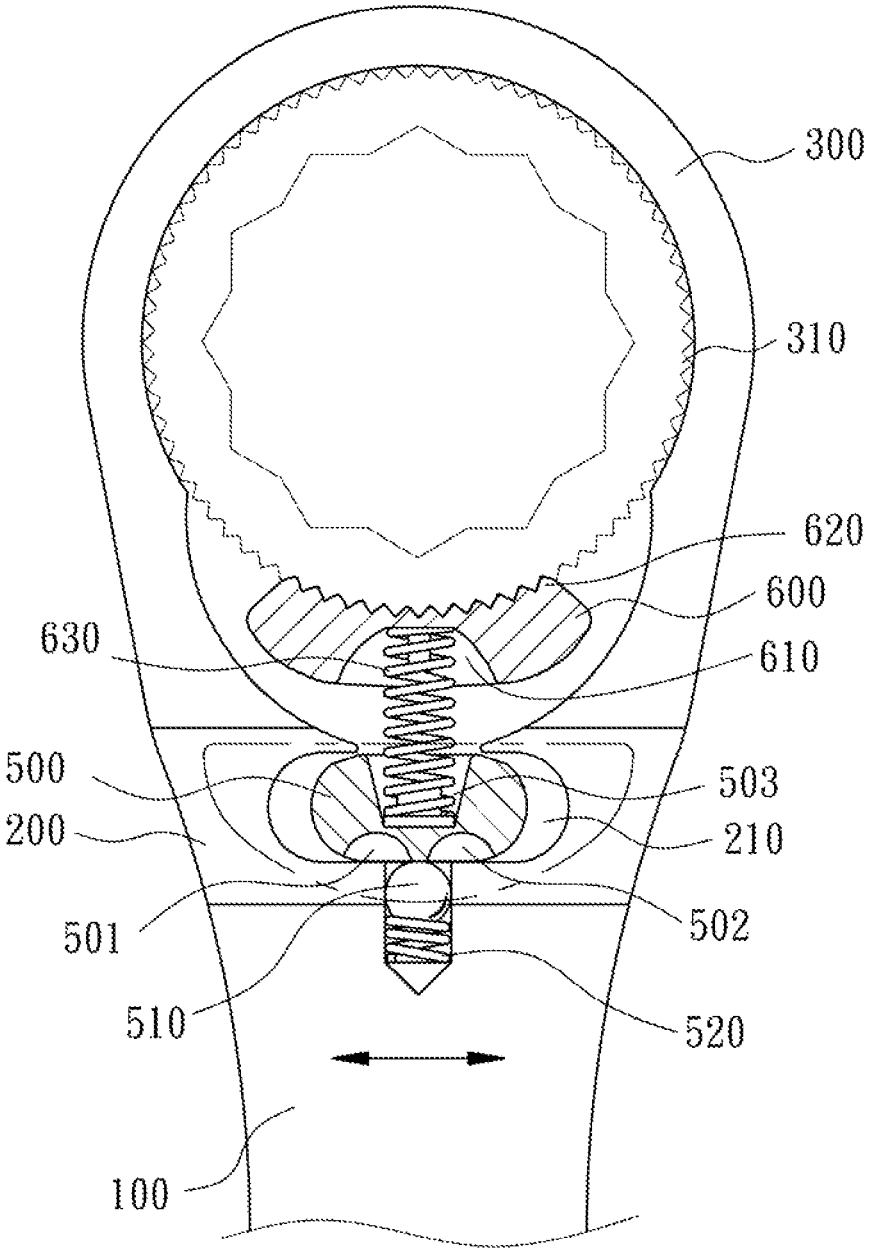
FIG. 1 is a schematic view of the ratchet wrench according to one embodiment of the disclosure.
Figure 2:
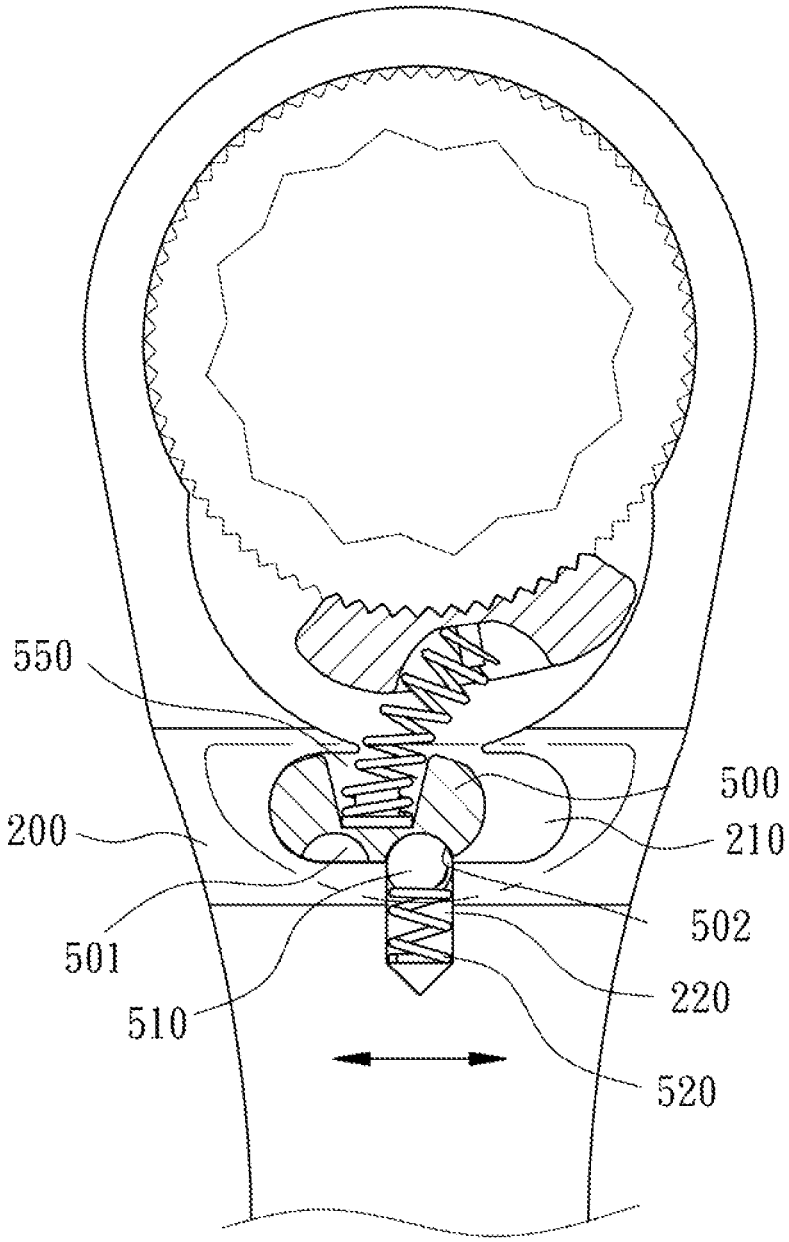
FIG. 2 is a schematic view depicting the operating direction controlling mechanism in FIG. 1.

Referring to FIG. 1 and FIG. 2, FIG. 1 is a schematic view of the ratchet wrench according to one embodiment of the disclosure, and FIG. 2 is a schematic view depicting the operating direction controlling mechanism in FIG. 1. In FIG. 1, the ratchet wrench includes a holding portion 100, a neck portion 200, a switching member 500, a controlling rod (not shown), a blocking member 600, and a ratchet driving head 300. The holding portion 100 has a top end and a bottom end. The neck portion 200 has a cavity 210, and the neck portion 200 is located at the top end of the holding portion 100. The cavity 210 has a first recess 220 (see FIG. 2) located at its bottom and an opening located at its top. The first recess 220 is applied to be filled with a compressible elastic member 520 and a ball 510 in sequence, and the opening is applied to be filled and tightly fit with a bendable elastic member 630. The switching member 500 is located inside the cavity 210. The switching member 500 has a second recess 550 at its top to hold the bottom of the bendable elastic member 630, and the switching member 500 also has two adjacent arc grooves at its bottom, i.e. the left arc groove 501 and the right arc groove 502. It is worthy to be noted that the shape of the second recess 550 must be designed to allow the bendable elastic member 630 to be bent inside the second recess 550.

The controlling rod links the switching member 500, and the controlling rod is extended to the surface of the neck portion 200. The controlling rod is applied to level shift the switching member 500 inside the cavity 210, and thus to allow the ball 510 to be pressed into one of the arc grooves by the compressible elastic member 520. Therefore, the switching member 500 is fixed at a predetermined angle by the ball 510 and thus the bendable elastic member 630 is bent toward either side of the holding portion 100. The blocking member 600 is located above the cavity 210. The blocking member 600 has a cave 610 at its bottom to hold the top of the bendable elastic member 630. The top structure of the blocking member 600 is an arc shaped concave surface, and a first teeth structure 620 is disposed at the arc shaped concave surface. The ratchet driving head 300 is located above the neck portion 200, and the ratchet driving head 300 has a space to install a ratchet, and the ratchet has a second teeth structure 310 disposed at its surface to correspond the first teeth structure 620 of the blocking member 600. Similarly, the shape of the cave 610 must be designed to let the bendable elastic member 630 able to be bent inside the cave 610.

In FIG. 2, when a user turns the controlling rod to level shift the switching member 500 to left, the ball 510 is pressed and stuck into the right arc groove 502. Meanwhile, the switching member 500 is fixed at a predetermined position, and thus the bendable elastic member 630 is bent toward the right side of the holding portion 100. Therefore, the cave 610 is pressed to drive the blocking member 600, and thus the first teeth structure 620 engages the second teeth structure 310 at the right side. As described above, the operating direction of the ratchet driving head 300 is set thereby, and thus the ratchet of the wrench can only be turned clockwise. On the contrary, if the user turns the controlling rod to level shift the switching member 500 to the right, the ball 510 is pressed and stuck into the left arc groove 501. Meanwhile, the bendable elastic member 630 is bent toward the left side of the holding portion 100. Therefore, the first teeth structure 620 engages the second teeth structure 310 at the left side, and thus the wrench can only be turned counter-clockwise.

Figure 3:
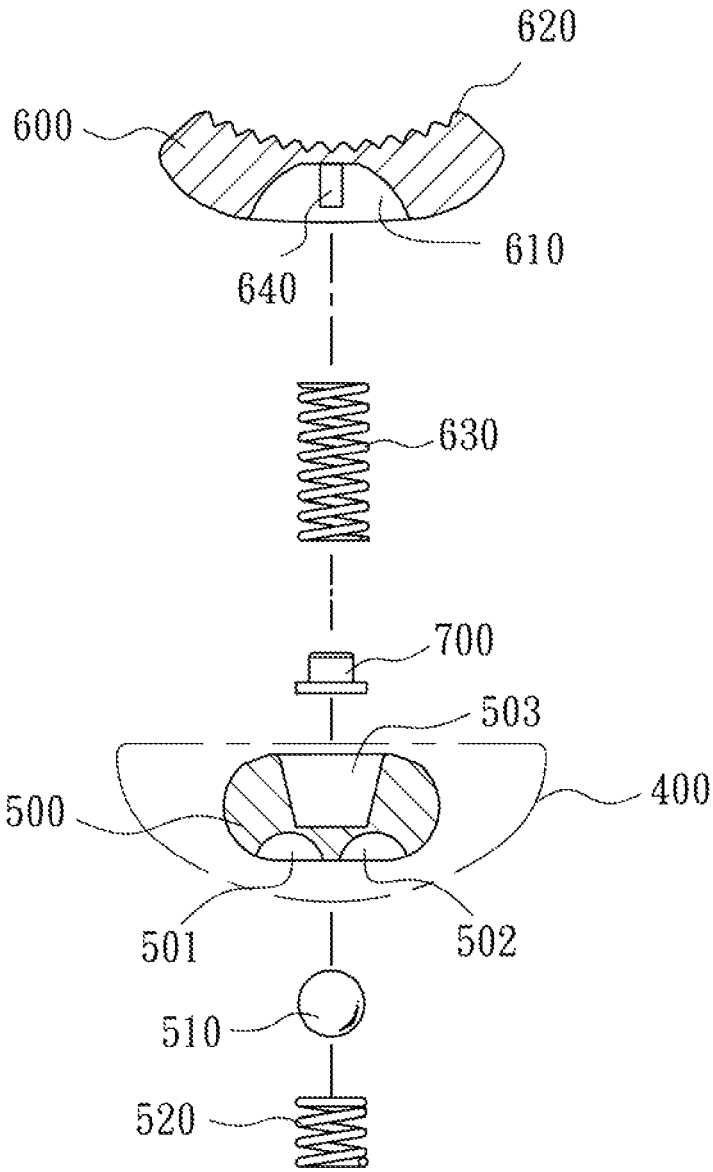
FIG. 3 is an exploded view of the operating direction controlling mechanism in FIG. 2.

Referring to FIG. 3, FIG. 3 is an exploded view of the operating direction controlling mechanism in FIG. 2. In FIG. 3, the bendable elastic member 630 and the compressible elastic member 520 are both formed by respective springs. On the other hand, an axis block 640 and a filled block 700 are further provided to enhance the structure of the ratchet wrench. When the bendable elastic member 630 is a spring, the axis block 640 can be embedded into the top hollow space of the spring, and the filled block 700 can be embedded into the bottom hollow space of the spring. The axis block 640 with a diameter smaller than that of the spring prevents the spring from escaping from the cave 610 when the blocking member 600 is rotated greatly. The filled block 700 can be applied to adjust the bending grade of the spring. The reason why the diameters of the axis block 640 and the filled block 700 are different from each other is that, the axis block 640 can be used to bear the force caused by the relative displacement between the spring and the blocking member 600, and thus performs as a buffer. The filled block 700 is applied to fix the bottom of the spring. Therefore, the shape of the filled block 700 can be designed as a stick or a stick with a base. In detail, when the filled block 700 is a stick, the stick links the switching member 500. On the other hand, when the filled block 700 is a stick with a base, the base is pressed by the spring to contact the switching member 500 firmly. In consideration of the arc grooves, the left arc groove 501 and the right arc groove 502 are adjacent to each other, and thus the operating direction of the ratchet can be controlled by turning the controlling rod slightly.

Figure 4:
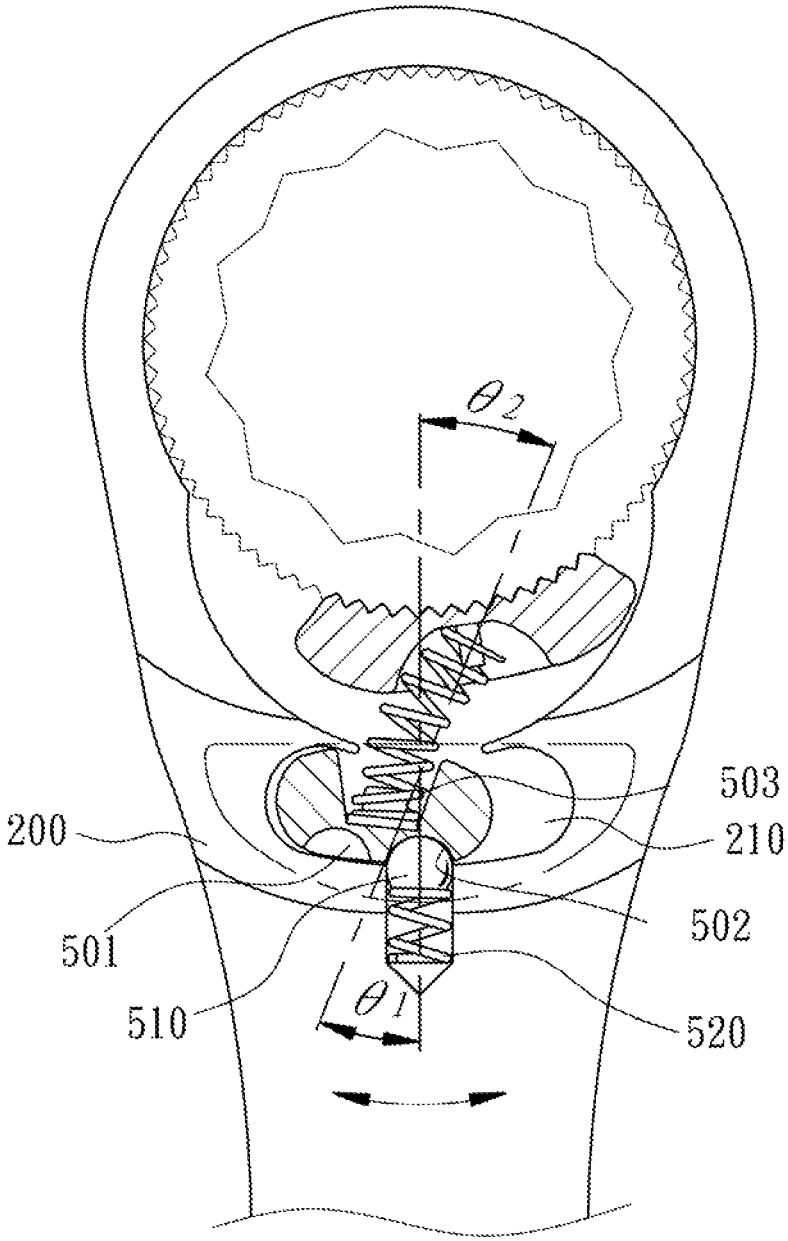
FIG. 4 is a schematic view of the ratchet wrench according to another embodiment of the disclosure.

Referring to FIG. 4, FIG. 4 is a schematic view of the ratchet wrench according to another embodiment of the disclosure. In FIG. 4, the cavity 210 is designed to be a chamber with hollow arc space in shape. The switching member 500 is controlled by the controlling rod, and rotated inside the cavity 210. Therefore, as shown in FIG. 4, as long as the switching member 500 is rotated by the controlling rod with a small angle $\theta_1$ the blocking member 600 can be rotated with a large angle $\theta_2$.

Figure 5:
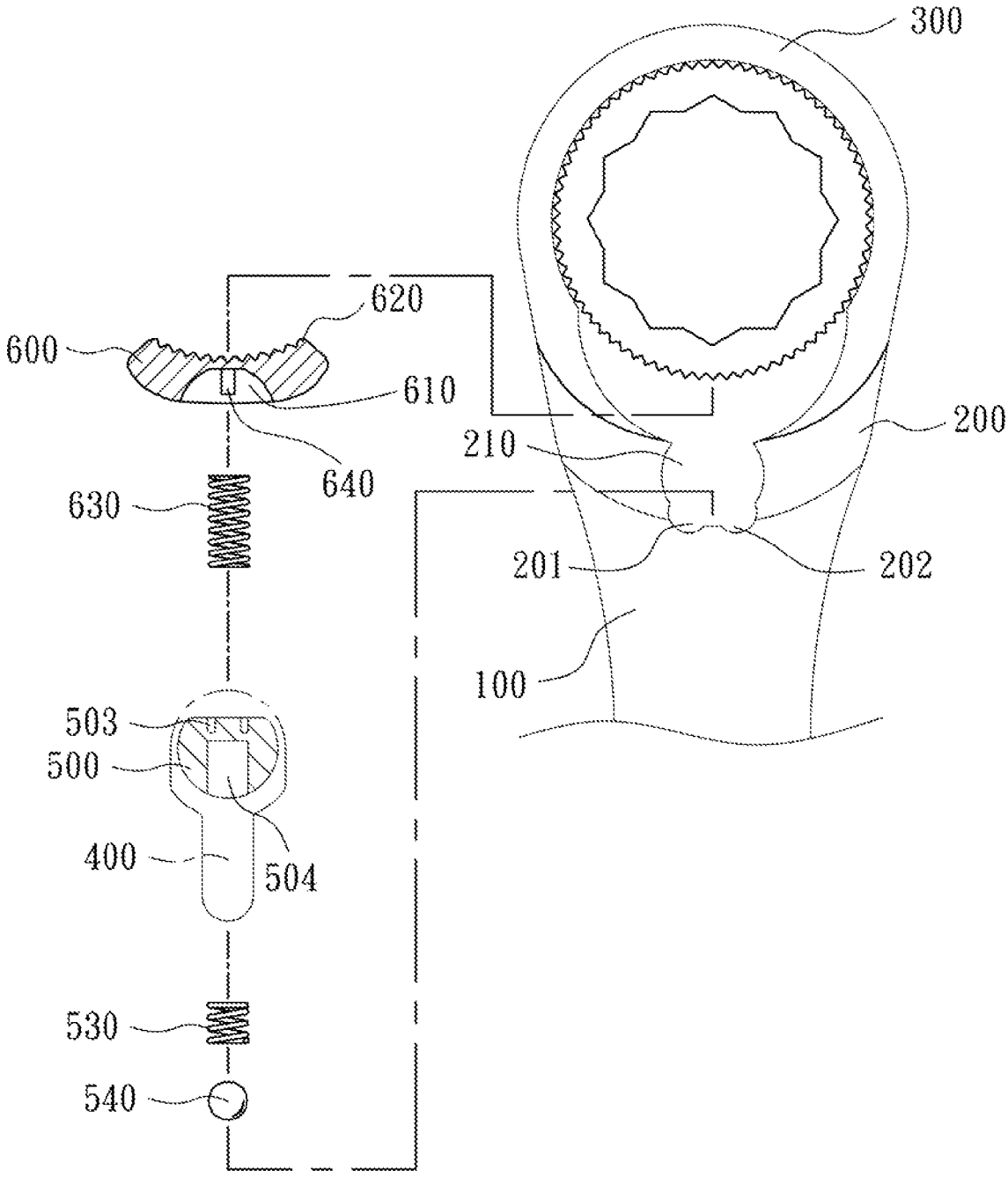
FIG. 5 is a schematic view of the ratchet wrench according to still another embodiment of the disclosure.

Finally, referring to FIG. 5, FIG. 5 is a schematic view of the ratchet wrench according to still another embodiment of the disclosure. In FIG. 5, the ratchet wrench includes a holding portion 100, a neck portion 200, a switching member 500, a controlling rod 400, a blocking member 600, and a ratchet driving head 300. The holding portion 100 has a top end and a bottom end. The neck portion 200 has a cavity 210, and the neck portion 200 is located at the top end of the holding portion 100. It is worthy to be noted that the cavity 210 has an opening located at its top and two adjacent arc grooves located at its bottom, i.e. the left arc groove 201 and the right arc groove 202. The opening is applied to be filled and tightly fit with a bendable elastic member 630, such as a flexible stick or a spring. The switching member 500 is located inside the cavity 210. The switching member 500 has a first recess 503 at its top to hold the bottom of the bendable elastic member 630, and the switching member 500 also has a second recess 504 at its bottom to hold the spring 530 and a ball 540 in sequence. The controlling rod 400 links the switching member 500, and is partially extended to the surface of the neck portion 200. The controlling rod 400 rotates the switching member 500 inside the cavity 210, and thus the ball 540 is pressed by the spring 530 and engaged into one of the arc grooves. Therefore, the switching member 500 is fixed at a shift position, and the bendable elastic member 630 is bent to the corresponding side.

The blocking member 600 is located above the cavity 210. The blocking member 600 has a cave 610 at its bottom to hold the top of the bendable elastic member 630. The top structure of the blocking member 600 is an arc shaped concave surface, and a first teeth structure 620 is disposed at the arc shaped concave surface. The ratchet driving head 300 is located above the neck portion 200, and the ratchet driving head 300 has a space to install a ratchet, and the ratchet has a second teeth structure disposed at its surface to correspond the first teeth structure 620 of the blocking member 600. Similarly, the shape of the cave 610 must be designed to allow the bendable elastic member 630 to be bent inside itself. Therefore, the first teeth structure 620 engages the second teeth structure of the ratchet driving head 300 at its either side when the blocking member 600 is pressed by the bendable elastic member 630. As a result, the operating direction of the ratchet wrench can be controlled by slightly turning the controlling rod 400.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A ratchet wrench, comprising:

a holding portion having a top end and a bottom end;

a neck portion which has a cavity and is located at the top end of the holding portion, the cavity having a first recess located at its bottom and an opening located at its top, the first recess being filled by a compressible elastic member and a ball in sequence, the opening being inserted and tightly fit with a bendable elastic member;

a switching member installed inside the cavity, the switching member having a second recess with a base diverging to a wider opening formed therein at its top, a filled block installed in the base of the second recess being inserted into a bottom hollow space of the bendable elastic member for holding a bottom of the bendable elastic member, and the switching member having two nearby arc grooves at its bottom;

a controlling rod which extends to a surface of the neck portion and links the switching member to shift the switching member in the cavity, thus allowing the ball to be pressed into one of the arc grooves by the compressible elastic member, whereby, the switching member is fixed at a predetermined angle by the ball and thus the bendable elastic member is bent toward one side of the holding portion;

a blocking member located above the cavity, the blocking member having a cave formed therein, an axis block installed on the cave being inserted into a top hollow space of the bendable elastic member, the cave engaging with a top of the bendable elastic member and being pressed by the bendable elastic member to rotate itself, the blocking member having an arc shaped concave surface at its top and a first teeth structure disposed at the arc shaped concave surface; and a ratchet driving head located above the blocking member, the ratchet driving head having a space to install a ratchet, the ratchet having a second teeth structure disposed at its surface to correspond the first teeth structure;

wherein, the blocking member is rotated and fixed when the bendable elastic member is bent, and thus the first teeth structure meshes one side of the second teeth structure to control an operating direction of the ratchet driving head;

wherein a portion of the cavity of the neck portion between the first recess of the cavity and the opening of the cavity, and that receives the switching member is formed as a transversely disposed substantially elliptical chamber;

wherein the bendable elastic member is a coil spring that has a diameter, and that further has an upper end section received in the cave and supported by the axis block in the blocking member and a lower end section received in the second recess and supported by the filled block formed in the switching member;

wherein a diameter of the axis block is smaller than a diameter of the filled block;

wherein an opening of the cave of the blocking member is wider than the opening of the second recess of the switching member;

wherein the cave of the blocking member, the diameter of the axis block, the second recess of the switching member and the diameter of the filled block are sized such that a movement of switching member by a small angle results in a movement of the blocking member by a larger angle.

2. The ratchet wrench of claim 1, wherein the controlling rod is applied to level shift the switching member in the cavity.

3. The ratchet wrench of claim 1, wherein the compressible elastic member is a spring.

4. A ratchet wrench, comprising:

a holding portion having a top end and a bottom end;

a neck portion which has a cavity and is located at the top end of the holding portion, the cavity having two nearby arc grooves at its bottom and an opening at its top, the opening being inserted with a bendable elastic member;

a switching member installed inside the cavity, the switching member having a first recess at its top defining a filled block being inserted and tightly fit into a bottom hollow space of the bendable elastic member for holding a bottom of the bendable elastic member, the switching member having a second recess located at its bottom, the second recess being filled by a compressible elastic member and a ball in sequence;

a controlling rod which extends to a surface of the neck portion and links the switching member to rotate the switching member in the cavity, thus allowing the ball to be pressed into one of the arc grooves by the compressible elastic member, whereby, the switching member is fixed at a predetermined angle by the ball and thus the bendable elastic member is bent toward one side of the holding portion;

a blocking member located above the cavity, the blocking member having a cave, an axis block installed on the cave being inserted into a top hollow space of the bendable elastic member, the cave engaging with a top of the bendable elastic member and being pressed by the bendable elastic member to rotate itself, the blocking member having an arc shaped concave surface at its top and a first teeth structure disposed at the arc shaped concave surface; and a ratchet driving head located above the blocking member, the ratchet driving head having a space to install a ratchet, the ratchet having a second teeth structure disposed at its surface to correspond the first teeth structure;

wherein, the blocking member is rotated and fixed when the bendable elastic member is bent, and thus the first teeth structure meshes one side of the second teeth structure to control an operating direction of the ratchet driving head;

wherein a portion of the cavity of the neck portion between the two nearby arc grooves of the cavity and the opening of the cavity, and that receives the switching member is formed as a chamber with an arc shape that arcs upwardly;

wherein the bendable elastic member is a coil spring that has a diameter, and that further has an upper end section received in the cave and supported by the axis block in the blocking member and a lower end section received in the first recess and supported by the filled block in the switching member;

wherein a diameter of the axis block is smaller than a diameter of the filled block;

wherein an opening of the cave of the blocking member is wider than an opening defined by the first recess of the switching member;

wherein the cave of the blocking member, the diameter of the axis block, the first recess of the switching member and the diameter of the filled block are sized such that a rotation of switching member by a small angle results in a movement of the blocking member by a larger angle.

5. The ratchet wrench of claim 4, wherein the compressible elastic member is a spring.

* * * * *